US005653103A

United States Patent [19]

Katoh

[11] Patent Number: 5,653,103

[45] Date of Patent: Aug. 5, 1997

[54] FUEL SUPPLY FOR INJECTED ENGINE

[75] Inventor: Masahiko Katoh, Hamamatsu, Japan

[73] Assignee: Sanshin Kogyo Kabushiki Kaisha, Hamamatsu, Japan

[21] Appl. No.: 545,221

[22] Filed: Oct. 19, 1995

[30] Foreign Application Priority Data

Oct. 19, 1994 [JP] Japan ..... 6-253705

[51] Int. Cl.[6] ..... F01N 3/00

[52] U.S. Cl. ..... 60/283

[58] Field of Search ..... 60/283

[56] References Cited

U.S. PATENT DOCUMENTS 3,911,675 10/1975 Mondt ..... 60/283
3,928,971 12/1975 Spath ..... 60/283
4,993,225 2/1991 Giacomazzi et al. ..... 60/283
5,245,975 9/1993 Ito ..... 60/283

*Primary Examiner*—John T. Kwon
*Attorney, Agent, or Firm*—Knobbe, Martens, Olson & Bear, LLP

[57] ABSTRACT

An internal combustion engine with a fuel-vapor reduction arrangement, including a combustion chamber, an induction system for introducing an air-fuel charge to the combustion chamber, a fuel charge-forming system for supplying a fuel charge to said combustion chamber, an exhaust system for releasing combustion exhaust from the combustion chamber to the atmosphere, and a fuel-supply system for supplying fuel to the fuel charge-forming system. The fuel-supply system including a fuel-vapor separator and a fuel-vapor conduit connecting the fuel-vapor separator to a point of the engine so that fuel vapors are not directly released to the atmosphere and do not interfere with the air-fuel ratio in the engine.

20 Claims, 7 Drawing Sheets

FUEL SUPPLY FOR INJECTED ENGINE

BACKGROUND OF THE INVENTION

This invention relates to a fuel-supply system of an internal combustion engine, and more particularly, to a fuel-supply system for extracting fuel vapors and other vapors and rendering them harmless before returning them to the atmosphere.

It is well known that fuel vapors can be problematic in the fuel-supply system for internal combustion engines, especially engines of the two-cycle crankcase-compression type with fuel injectors. Fuel vapors are unpredictable and their concentration in the fuel-supply system varies. The unpredictability of the vapors causes the charge former to run lean or rich, resulting in poor engine performance.

In the past, fuel-vapor separators were installed in the fuel supply to give vapors a chance to come off the liquid fuel so that they were not mixed with the liquid fuel in the fuel discharge running to the charge former. A vent is provided on the separator to remove fuel vapors to the engine or atmosphere. Fuel vapors vented to the engine are mixed with a preexisting air-fuel charge. Although venting the fuel vapors to the engine helped to prevent mixing with the liquid fuel, the solution is temporary because the fuel vapors transferred to the engine interfere with the proper air-fuel ratio in the engine. Venting the fuel vapors directly to the atmosphere is not an acceptable solution because it causes additional harm to the environment.

It is therefore a principal object of this invention to provide an internal combustion engine with a fuel-supply system that removes fuel vapors from the liquid fuel without directly releasing the vapors to the atmosphere and without transferring the vapors to the engine in such a way that the air-to-fuel ratio in engine is affected.

It is a further object of this invention to provide a fuel-vapor reduction arrangement particularly adapted for use with a two cycle internal combustion engine.

Further objects and advantages will be apparent from the ensuing figures and description of the invention.

SUMMARY OF THE INVENTION

An internal combustion engine with a fuel-vapor reduction arrangement comprising a fuel-vapor separator and fuel-vapor path connected to the engine so that fuel vapors are not directly released to the atmosphere and do not interfere with the proper air-fuel ratio in the engine.

DETAILED DESCRIPTION OF THE PREFERRED EMBODIMENTS

Figure 1:
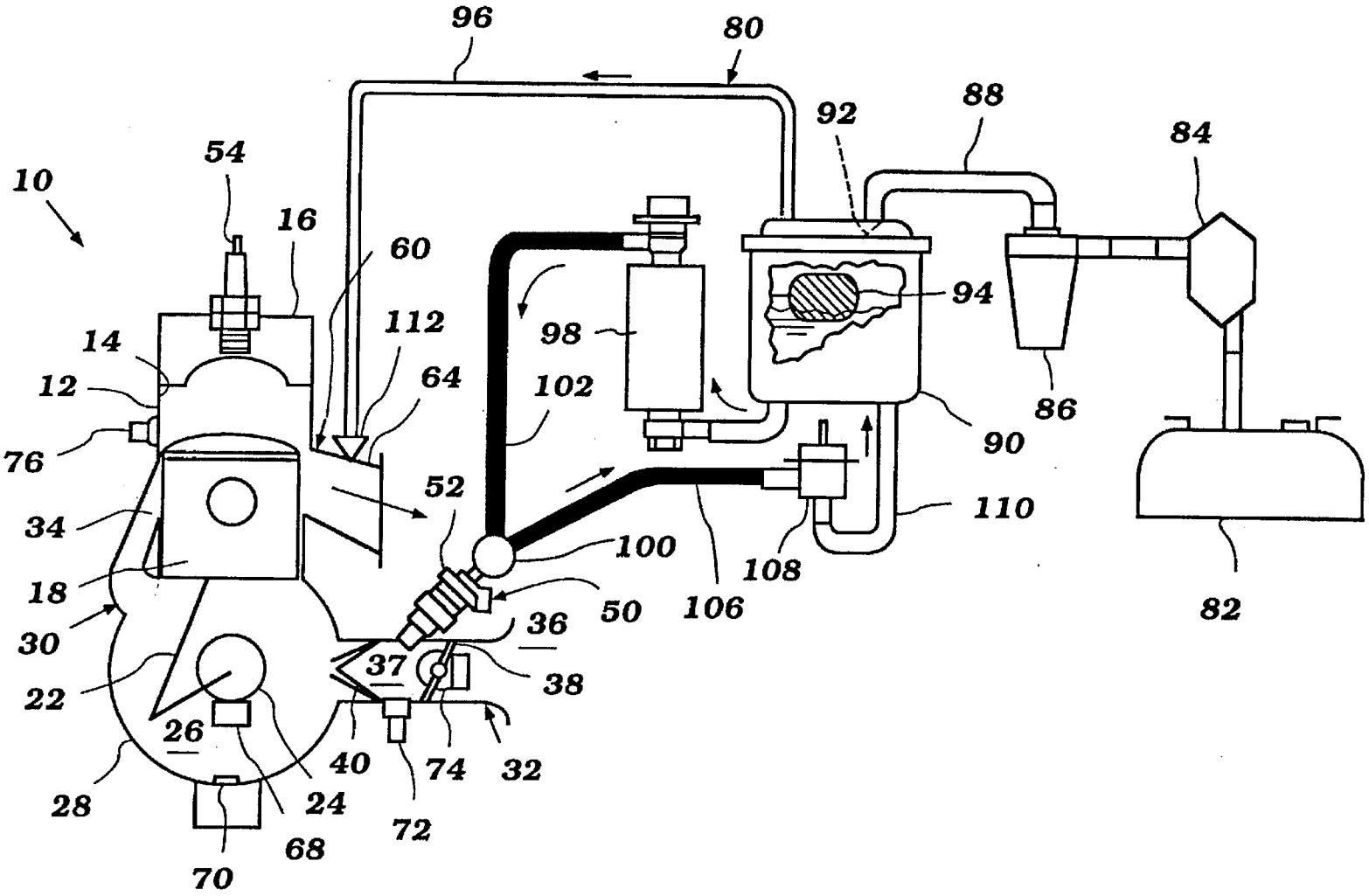
FIG. 1 is a partially schematic cross-sectional view of one embodiment of the present invention, taken through one cylinder of an engine with a fuel supply system.

FIG. 1 is a schematic cross-sectional view of the fuel-supply system of the present invention applied to an internal combustion engine 10. FIG. 1 is a view taken through a single cylinder of the engine 10, which is of a three-cylinder in-line configuration. The internal combustion engine 10 is depicted as being of the two-cycle crankcase-compression type. Although this particular configuration is illustrated, it will be apparent to those skilled in the art how the invention may be employed with other types of engines having other numbers of cylinders and other cylinder orientations. In fact, certain facts of the invention may also be employed with rotary or other ported-type engines and/or with four cycle engines.

The engine 10 includes a cylinder block 12 in which a plurality of cylinder bores 14 are formed. A cylinder head assembly 16 is affixed to the cylinder block 12 in any known manner. Pistons 18 reciprocate in the cylinder bores 14. A plurality of respective combustion chambers 20 are formed by the heads of the pistons 18, cylinder bores 14 and the cylinder head assembly 16. The pistons 18 are connected by means of connecting rods 22 to a crankshaft 24. The crankshaft 24 is in turn journaled for rotation within a crankcase chamber 26 in a suitable manner. Each crankcase chamber 26 is formed by the cylinder block 12 and a crankcase chamber member 28 affixed to the cylinder block 12 in any known manner. As is well known in the art, the crankcase chambers 26 associated with each of the cylinder bores 14 are sealed relative to each other in an appropriate manner.

An air charge, to be described, is delivered to each of the combustion chambers 20 by an air induction system 30, which will now be described. An air-inlet device 32 draws atmosphere air through an air inlet 36 into an intake passage 37. A throttle valve 38 is positioned in an intake manifold 39 downstream of the air inlet 36 and is operated in any known manner. Air flows through the intake passage 37 and discharges into intake ports (not shown) formed in the crankcase member 28. Reed-type check valves 40 are provided in each intake port for permitting the charge to be admitted to the crankcase chambers 26 when the pistons 18 are moving upwardly in the cylinder bores 14. The reed-type check valves 40 close when pistons 18 move downwardly to compress the charge in the crankcase chambers 26, as is well known in the art. The charge is transferred from the crankcase chambers 26 to the combustion chambers 20 through one or more scavenge passages 34.

Fuel is added to the air charge by a suitable fuel charge-forming system 50, which will now be described. Fuel injectors 52 are mounted in the intake manifold 39 downstream of the throttle valve 38. The fuel injectors 52 are preferably of the electronically-operated type, that is, they are provided with an electric solenoid that operates on an injector valve so as to open and close and deliver high pressure fuel towards check valves 40. Other fuel charge-forming systems, such as a carburetor, are possible. A fuel charge may also be introduced at different locations in the induction system 30 or directly into the combustion chamber 20 without detracting from the spirit of the invention.

Spark plugs 54 are mounted in the cylinder head assembly 16 and have their spark gaps (not shown) extending into the combustion chambers 20. The spark plugs 54 are fired by a capacitor discharge ignition system (not shown). This outputs a signal to a spark coil, which may be mounted on each spark plug 54, for firing the spark plug 54 in a known manner.

When each spark plug 54 fires, the charge in the respective combustion chamber 20 will ignite and expand so as to drive the piston 18 downwardly. The combustion products, or exhaust gases, are then discharged through the exhaust system 60, which will now be described. An exhaust port 62 is formed by the cylinder block 12. The head of the piston 18 opens the exhaust port 62 as the piston 18 moves downwardly after combustion. These exhaust gases flow through the exhaust port 62 and into an exhaust manifold 64. These exhaust gases may then flow through an exhaust passage and out an exhaust pipe (not shown) into the atmosphere.

In order to permit engine management and specifically fuel injection and ignition control, a number of sensors are employed. Some of these sensors are illustrated schematically. A crankcase angle sensor 68 which senses the angular position of the crankshaft 24 and also the speed of its rotation is provided at the crankshaft 24. A crankcase chamber pressure sensor 70 for sensing the pressure in the crankcase chamber 26 is provided at the crankcase chamber member 28. Among other things, this crankcase chamber pressure sensor 70 may be employed as a means for measuring intake air flow and controlling the amount of fuel injected by the fuel injectors 52, as well as its timing.

A temperature sensor 72 may be provided in the intake passage 37 downstream of the throttle valve 38 for sensing the temperature of the intake air. In addition, the position of the throttle valve 38 is sensed by a throttle position sensor 74 also located in the intake passage 37. A knock sensor 76 may be mounted in the cylinder block 12 for sensing the existence of a knocking condition 20.

Fuel is supplied to the engine 10 under high pressure by a fuel supply system, indicated generally by reference number 80, which will now be described. Fuel is pumped from a fuel tank 82 by means of a fuel pump 84, which may be electrically or otherwise operated. This fuel then passes through a fuel filter 86. Fuel flows from the fuel filter 86 through a conduit 88 into a fuel-vapor separator 90. The fuel-vapor separator 90 includes a float-controlled valve 92 for controlling the level of fuel in the fuel-vapor separator 90. A float 94 is operatively associated with the float control valve 92 to allow fuel into the fuel-vapor separator 90 when the fuel reaches a low level. The fuel-vapor separator 90 acts to draw off and separate fuel vapors and other vapors from the liquid fuel. The fuel-vapor separator includes a vent port 95 for removing fuel vapors from the fuel-vapor separator 90 in a manner to be described.

A high-pressure fuel pump 98 draws liquid fuel from the fuel-vapor separator 90 and delivers it under high pressure to a fuel rail 100 through a conduit 102. The fuel pump 98 is driven in any known manner, such as by an electric motor or directly from the engine 10. The fuel discharge is distributed to each of the fuel injectors 52 through the fuel rail 100.

A return conduit 106 extends from the fuel rail 100 to a pressure regulator 108. The pressure regulator 108 controls the maximum pressure in the fuel rail 100 that is supplied to the fuel injectors 52. This is done by dumping excess fuel back to the fuel-vapor separator 90 through a return line 110. The regulated pressure may be adjusted electrically along with other controls. Thus, the fuel-supply system 80 acts to re-circulate the fuel. This recirculation of the fuel helps to draw off fuel vapors from the liquid fuel.

Although the fuel-vapor separator 90 and recirculating nature of the fuel-supply system 80 help to draw off vapors from the liquid fuel, the vapors must be removed from the fuel-supply system 80 so that they do not present problems in the fuel injectors 52. Fuel vapors that are not removed may mix with the liquid fuel discharge and enter the fuel injectors 52. Fuel vapors in the fuel injector 52 are a problem because the concentration is not predictable and always varies. If the concentration of fuel vapors in the liquid fuel discharge running to the fuel injector 52 was predictable, the timing of the fuel injector 52 could be adjusted so that the proper amount of fuel would be injected into the engine 10. However, because of their unpredictability, of the vapors causes the fuel injectors 52 to run lean or rich, resulting in poor engine performance.

The fuel vapor reduction arrangement of the present invention is designed to remove fuel vapors from the fuel-vapor separator 90 to solve the above problems and deliver these vapors to a point on the engine so that fuel vapors are not directly released to the atmosphere and have such a minimal effect on the air-fuel ratio in the engine 10 that the proper air-fuel ratio is not interfered with.

The present invention has numerous related embodiments, as best shown in FIGS. 1–2 and 4–7. A fuel-vapor path, or conduit, 96 connects the vent port 95 of the fuel vapor separator 90 to a specific location on the engine 10 so that fuel vapors are removed from the fuel-vapor separator without discharging then directly to the atmosphere and do not interfere with the proper air-fuel ratio in the engine 10. The fuel-vapor path 96 is connected to points on the engine characterized generally as post-combustion points or pre-combustion points. Post-combustion points are those points on the engine 10 where fuel vapors are burned off by exhaust produced in the combustion chamber 20. Pre-combustion points are those points on the engine generally found in the induction system 30, those points where fuel vapors can be removed prior to the remaining vapors are mixed with the fuel-air charge supplied to the engine 10 prior to combustion.

In FIG. 1, the fuel-vapor path 96 is connected to the exhaust system 60 at the exhaust manifold 64 adjacent the exhaust port 62. Connecting fuel-vapor path 96 to the exhaust system 60 at this point allows fuel vapors to be burned off and forced out of the combustion chamber 20 with the exhaust gases produced by combustion. The fuel vapor path 96 includes a check valve 112 that allows fuel vapors to exit the vapor path 96 but prevents exhaust gases from entering it. Releasing fuel vapors into the exhaust system 60, as opposed to the combustion chamber 20, has the advantage of preventing variations in the fuel-air ratio in the engine 10. It is important to introduce the fuel vapors adjacent the exhaust port 62 so that the fuel vapors are burned or otherwise rendered harmless by hot exhaust gases.

Figure 2:
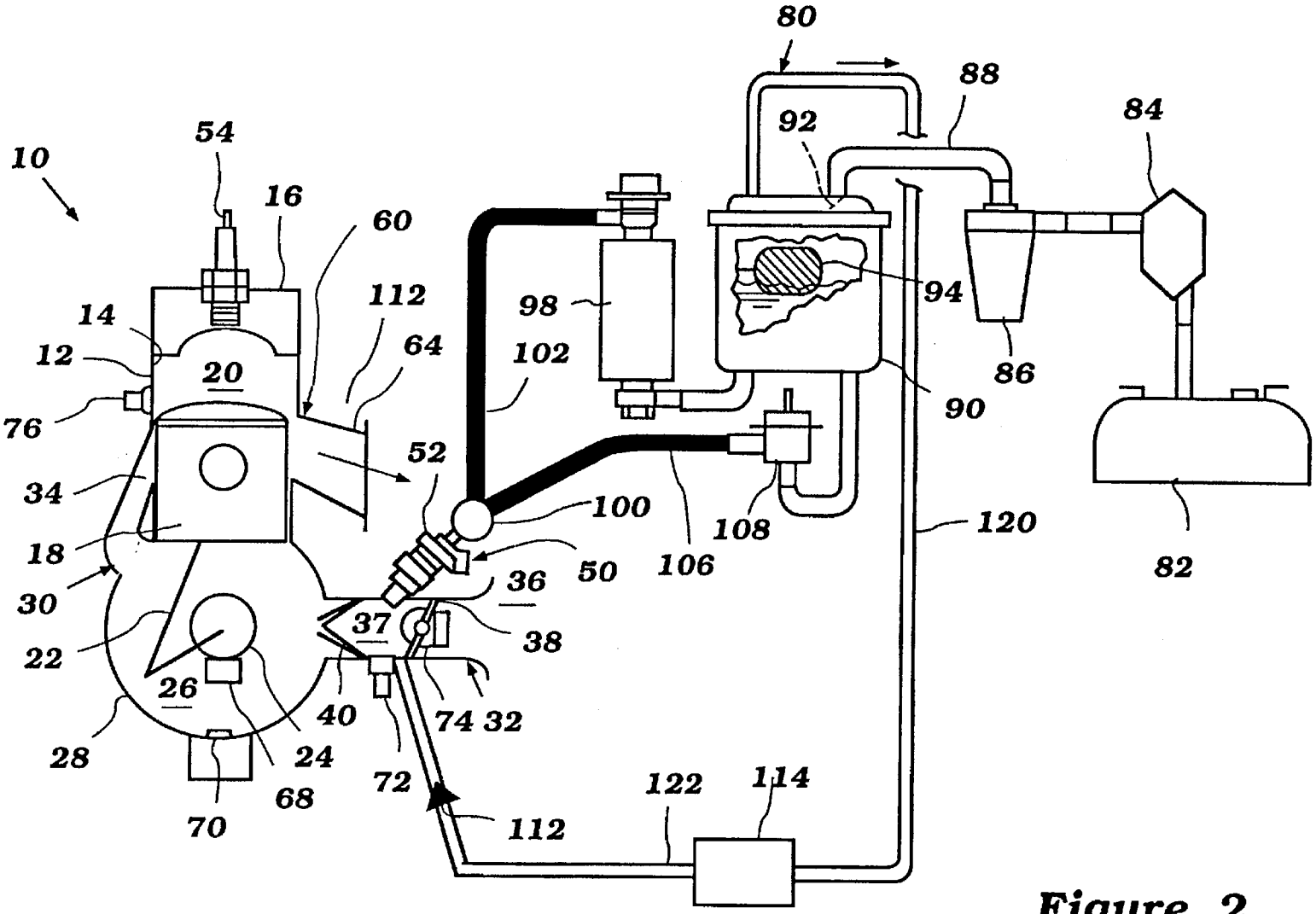
FIG. 2 is a schematic cross-sectional view in part, similar to FIG. 1, of a second embodiment of the present invention.

In FIG. 2, the fuel-vapor path 96 is connected to the induction system 30 at the intake passage 37 at a point downstream from the throttle valve 38 and upstream from the check valve 40. The advantage of connecting the fuel-vapor path 96 at this point is that sound deadening results from any non-combustible products condensing on the check valve 40.

Figure 3:
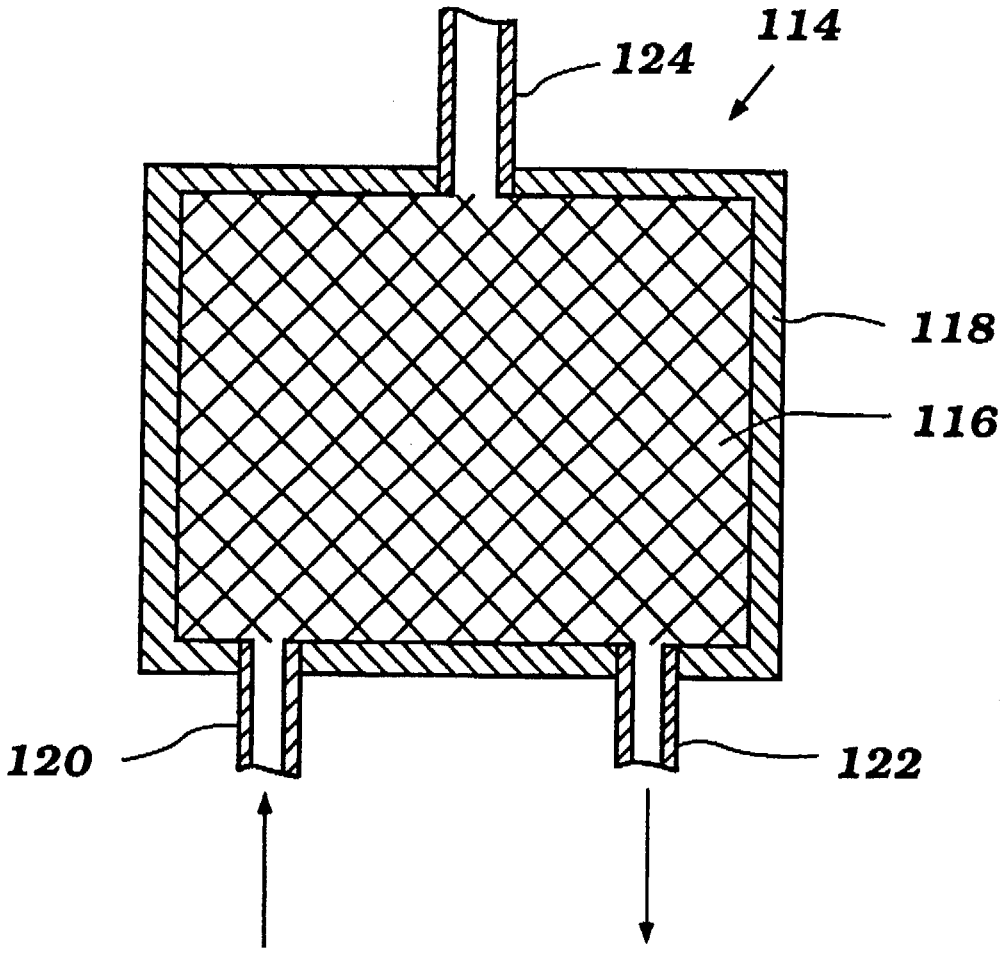
FIG. 3 is a cross-sectional view of a fuel-vapor reduction canister which is employed in certain embodiments.

The fuel-vapor path 96 includes a fuel-vapor reduction canister 114, as best shown in FIGS. 2 and 3. Canister 114 includes a fuel-absorption media 116 surrounded by a case 118. Canister 114 also includes fuel-vapor in and out paths 120 and 122, respectively. A vent passage 124 is provided in the case 118 in order to regulate the pressure of the fuel vapors flowing into the canister 114.

The fuel-vapor reduction canister 114 is used to extract the hydrocarbons vapors from the fuel-vapor path 96 by absorption within the fuel-absorption media 116. It is more important that canister 114 be used at pre-combustion points instead of post-combustion points because the fuel vapors interfere with the proper air-fuel ratio in the engine 10 at precombustion points.

Figure 4:
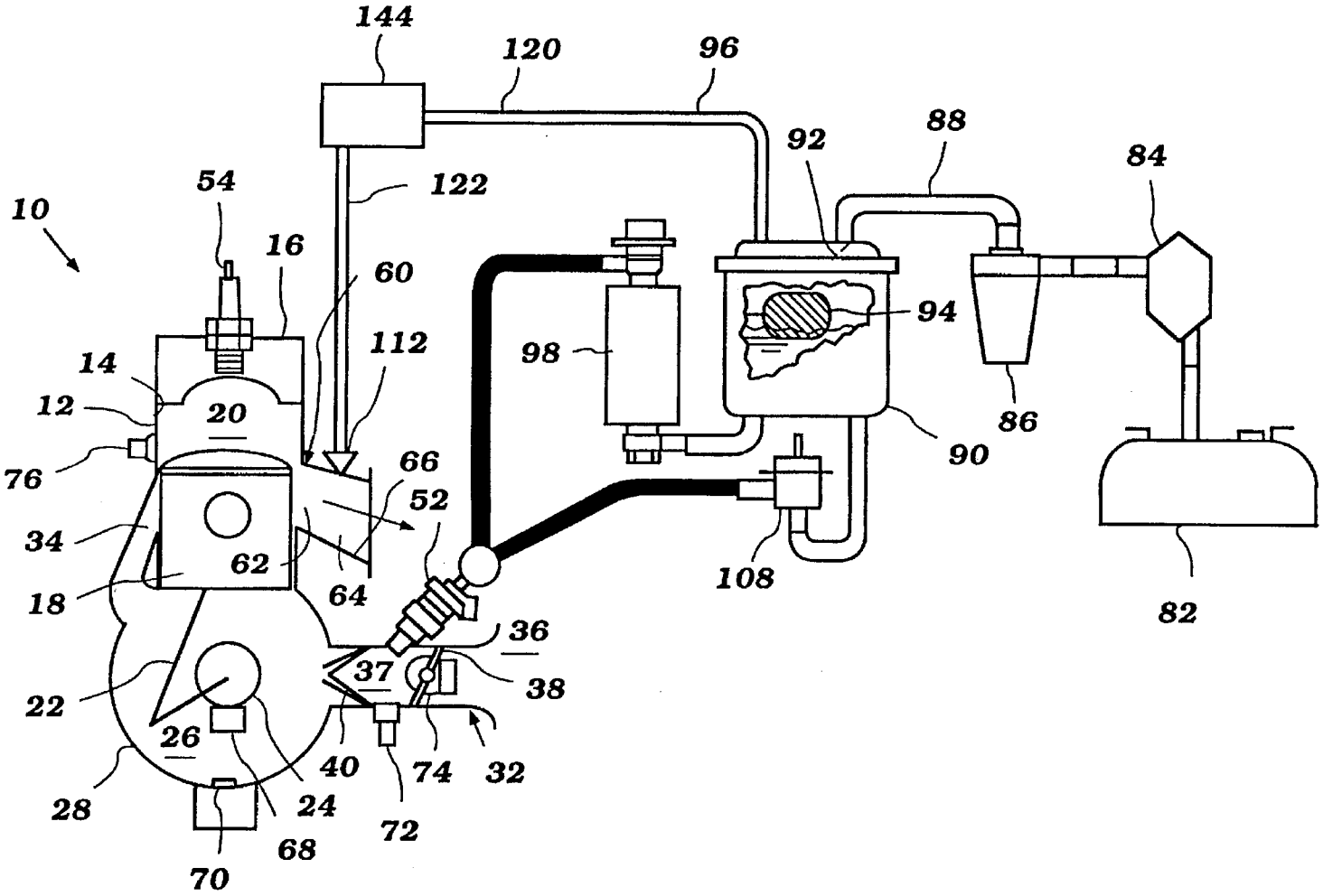
FIG. 4 is a schematic cross-sectional view in part, similar to FIGS. 1 and 2, of a third embodiment of the present invention.

Similar to FIG. 1, the fuel-vapor path 96 in FIG. 4 is connected to the engine 10 at the exhaust system 60. This embodiment of the invention also includes a fuel-vapor reduction canister 114 in the fuel-vapor path 96. The fuel-vapor reduction canister 114 reduces the amount of fuel vapors running to the exhaust system 60.

Figure 5:
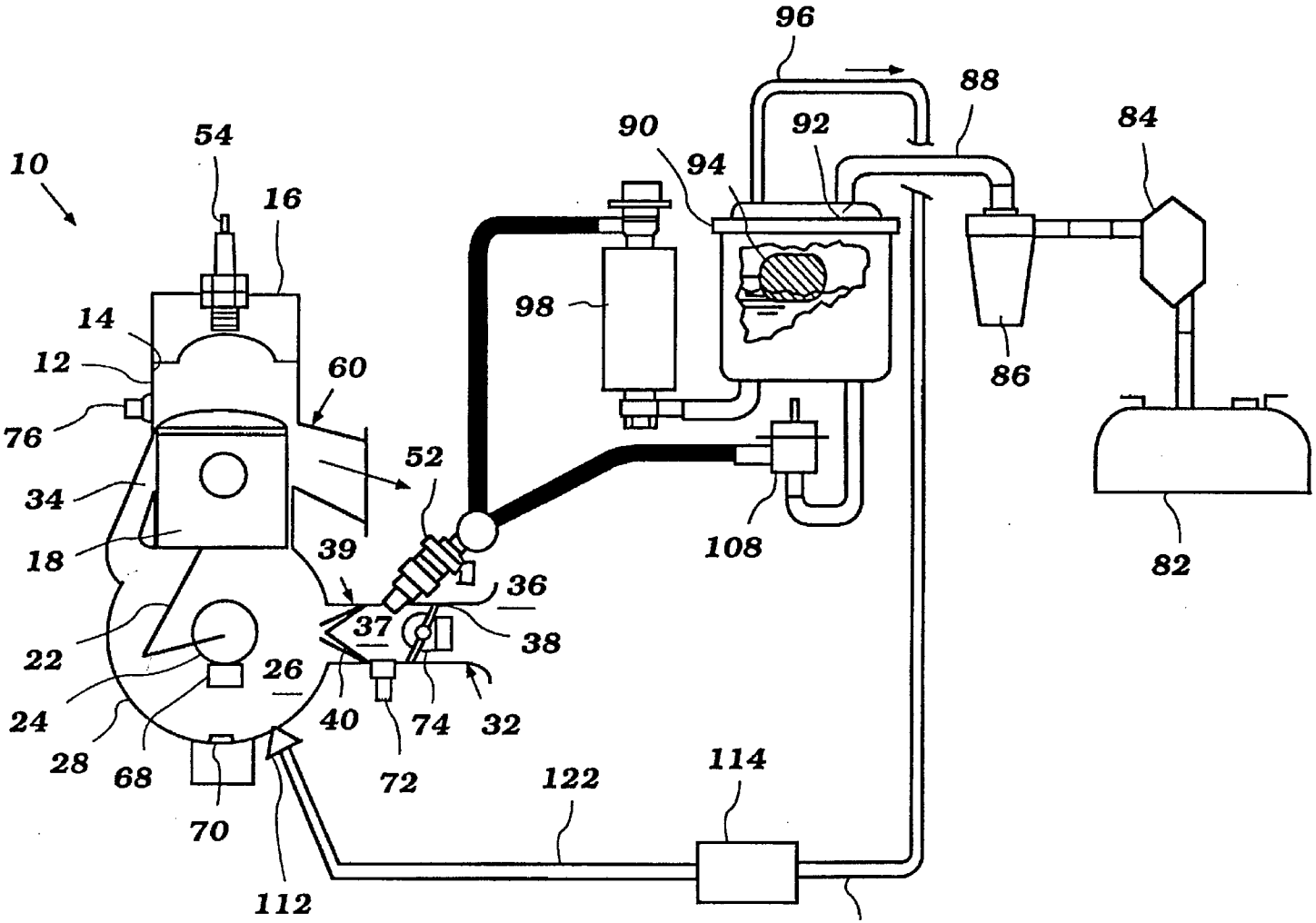
FIG. 5 is a schematic cross-sectional view in part, similar to FIGS. 1, 2, and 4, of a fourth embodiment of the present invention.

In FIG. 5, the fuel-vapor path 96 is connected to the induction system 30 at the crankcase chamber 26. Connecting the fuel-vapor path 96 at this point in the induction system 30 is advantageous over connecting the fuel-vapor path 96 at a point downstream the throttle valve 38 and upstream the check valve 40 because the vapors can better condense in the crankcase chamber 26. Fuel-vapor path 96 also includes a fuel-vapor reduction canister 114 for removal of hydrocarbons before introduction into the engine combustion chamber.

Figure 6:
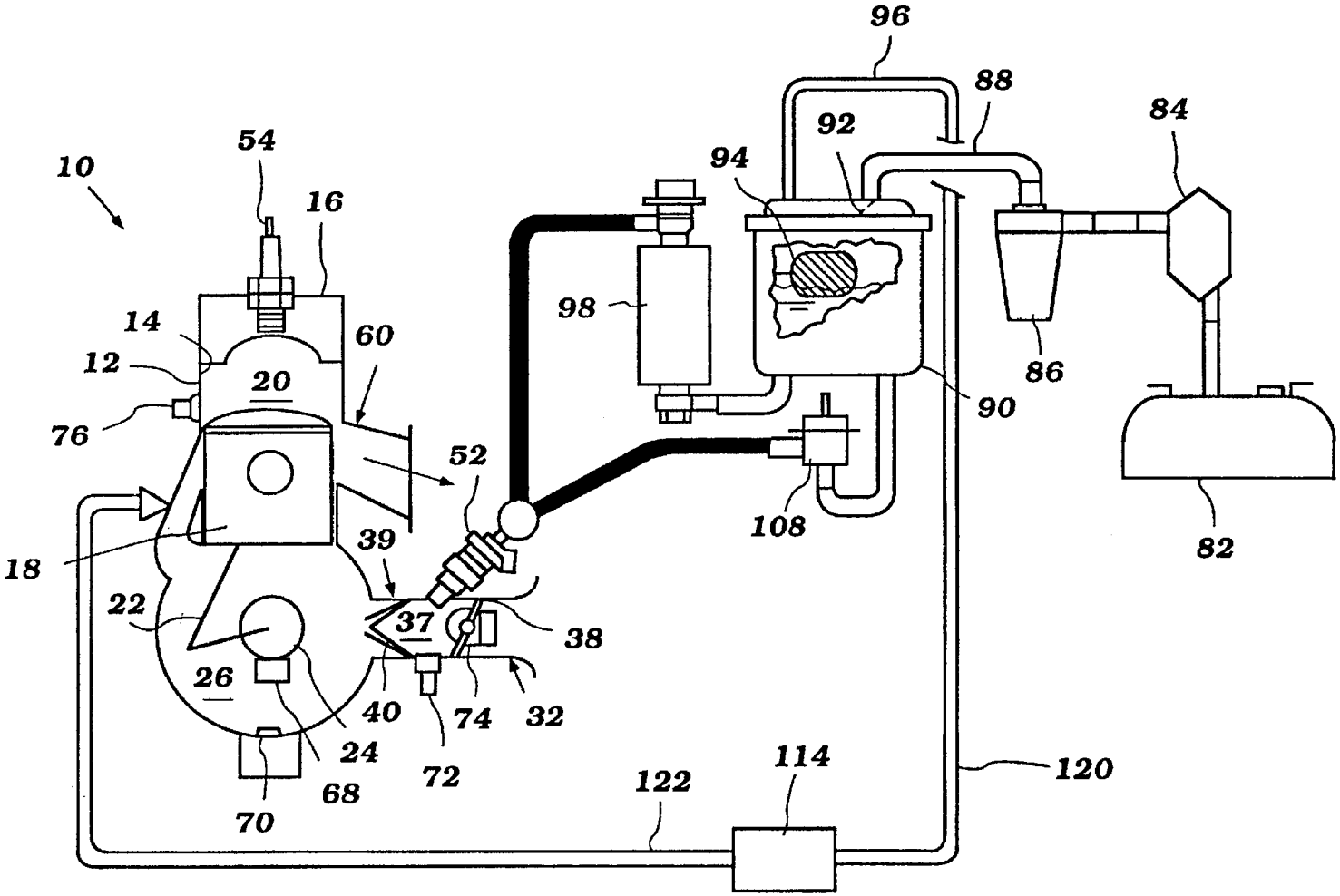
FIG. 6 is a schematic cross-sectional view in part, similar to FIGS. 1, 2, 4 and 5, of a fifth embodiment of the present invention.

In FIG. 6, the fuel-vapor path 96 is connected to the induction system 30 at the scavenge passage 34. Connecting the fuel-vapor path 96 at this pre-combustion point has the advantage of introducing the non-combustible vapors at an area of higher flow velocity to improve mixing. Fuel-vapor path 96 also includes a fuel-vapor reduction canister 114 for absorption of hydrocarbons before introduction of the vapors into the combustion chamber 20.

Figure 7:
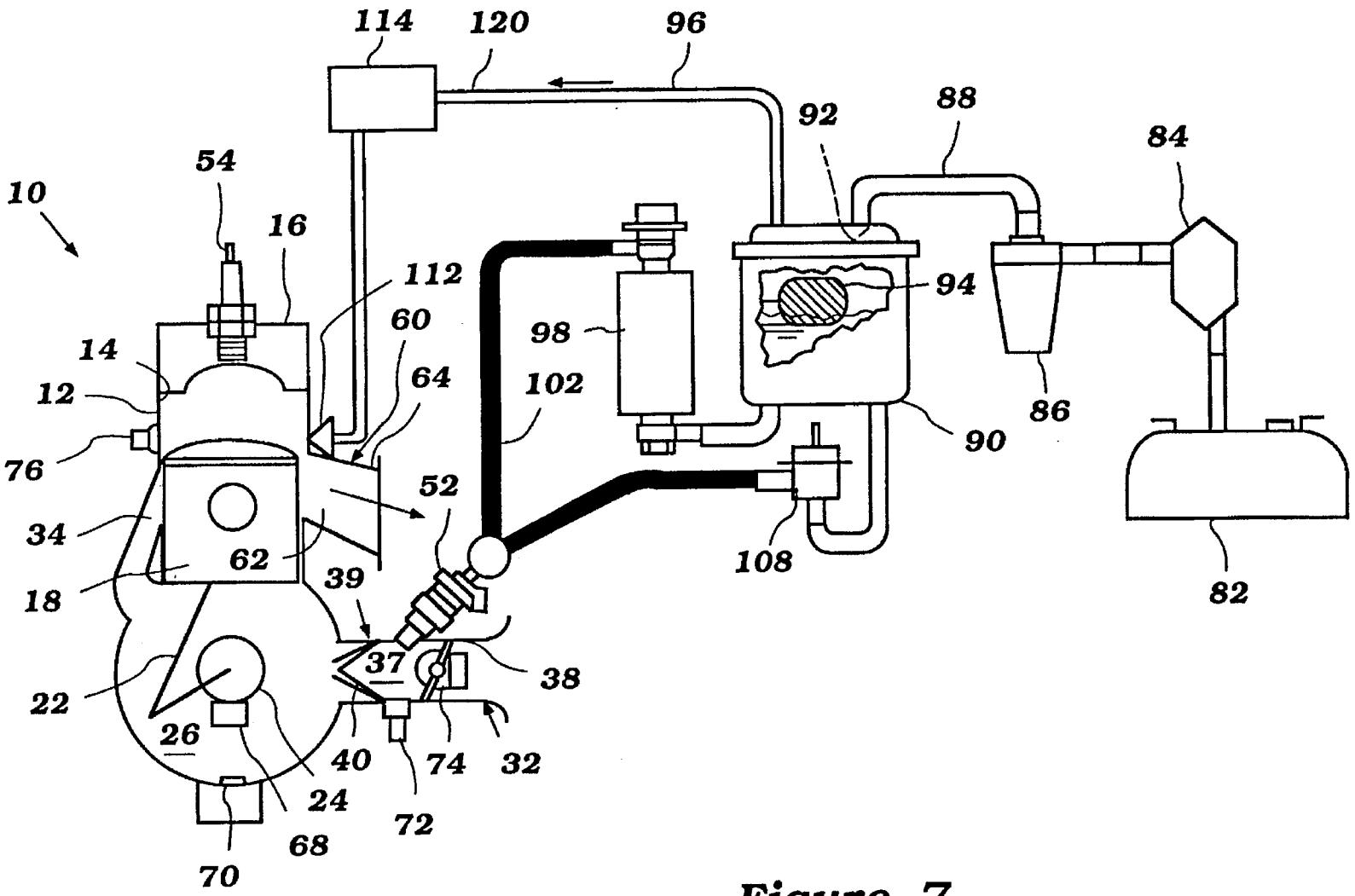
FIG. 7 is a schematic cross-sectional view in part, similar to FIGS. 1, 2 and 4–6, of a sixth embodiment of the present invention.

In FIG. 7, the fuel-vapor path 96 is connected to the combustion chamber 20 at a point adjacent to the exhaust port 62. The fuel-vapor path 96 is connected at this point so that any remaining combustible vapors are burned off by exhaust heat. The fuel-vapor path 96 also includes a fuel-vapor reduction canister 114, for absorption of hydrocarbons before any remaining vapors are delivered to the exhaust manifold 64.

Thus, from the foregoing description, it should be readily apparently that the described embodiments of the invention provide an effective way to reduce fuel vapors to an internal combustion engine and prevent fuel vapors from being directly discharged to the atmosphere. Of course, various changes and modifications may be made without departing from the spirit and scope of the invention, as defined by the appended claims.

What is claimed is:

1. An internal combustion engine with a fuel-vapor reduction arrangement comprising a combustion chamber, an air induction system for introducing an air-fuel charge to said combustion chamber, a fuel charge-forming system for supplying a fuel charge to said combustion chamber, an exhaust system for releasing combustion exhaust from said combustion chamber to the atmosphere, a fuel-supply system for supplying fuel to said fuel charge-forming system, said fuel-supply system including a fuel-vapor separator having a vent port, and a fuel-vapor conduit connecting said vent port of said fuel-vapor separator to a point of said engine so that fuel vapors are not directly released to the atmosphere and do not interfere with the proper air-fuel ratio in said engine.

2. The internal combustion engine of claim 1, wherein said fuel-vapor conduit includes a fuel-vapor reduction canister for absorbing fuel vapors.

3. The internal combustion engine of claim 2, wherein said fuel-vapor conduit connected to a post-combustion area in said engine.

4. The internal combustion engine of claim 3, wherein said fuel-vapor conduit is connected to said engine at an area where combustion is substantially completed so that the fuel vapors are burned by the heat of the combustion products.

5. The internal combustion engine of claim 4, wherein said fuel-vapor conduit is connected to said exhaust system so that the fuel vapors are burned off by the heat of the exhaust.

6. The internal combustion engine of claim 4, wherein said fuel-vapor conduit is connected to said combustion chamber of said engine.

7. The internal combustion engine of claim 1, wherein said fuel-vapor conduit is connected to a post-combustion area in said engine.

8. The internal combustion engine of claim 7, wherein said fuel-vapor conduit is connected to said engine at an area where combustion is substantially completed so that the fuel vapors are burned by the heat of the combustion products.

9. The internal combustion engine of claim 8, wherein said fuel-vapor conduit is connected to said exhaust system so that the fuel vapors are burned off by the heat of the exhaust.

10. The internal combustion engine of claim 8, wherein said fuel-vapor conduit is connected to said combustion chamber of said engine.

11. The internal combustion engine of claim 8, wherein said fuel-vapor conduit is connected to said combustion chamber of said engine.

12. The internal combustion engine of claim 1, wherein said engine is a two-cycle crankcase-compression engine.

13. The internal combustion engine of claim 12, wherein said fuel-vapor conduit includes a fuel-vapor reduction canister for absorbing fuel vapors.

14. The internal combustion engine of claim 12, wherein said fuel-vapor conduit is connected to a post-combustion area in said engine.

15. The internal combustion engine of claim 14, wherein said fuel-vapor conduit is connected to said engine at an area where combustion is substantially completed so that the fuel vapors are burned by the heat of the combustion products.

16. The internal combustion engine of claim 15, wherein said fuel-vapor conduit is connected to said combustion chamber of said engine.

17. The internal combustion engine of claim 15, wherein said fuel-vapor conduit is connected to said exhaust system so that the fuel vapors are burned off by the heat of the exhaust.

18. The internal combustion engine of claim 13, wherein the fuel-vapor conduit is connected to a post-combustion area in said engine.

19. The internal combustion engine of claim 18, wherein said fuel-vapor conduit is connected to said engine at an area where combustion is substantially completed so that the fuel vapors are burned by the heat of the combustion products.

20. The internal combustion engine of claim 19, wherein said fuel-vapor conduit is connected to said exhaust system so that the fuel vapors are burned off by the heat of the exhaust.

* * * * *